United States Patent [19]

Oberdorfer

[11] Patent Number: 4,665,581

[45] Date of Patent: May 19, 1987

[54] VACUUM CLEANER APPARATUS

[75] Inventor: Guido Oberdorfer, Bellenberg, Fed. Rep. of Germany

[73] Assignee: Guido Oberdorfer WAP-Maschinen, Bellenberg, Fed. Rep. of Germany

[21] Appl. No.: 816,967

[22] Filed: Jan. 8, 1986

Related U.S. Application Data

[63] Continuation of Ser. No. 511,515, Jul. 6, 1983, abandoned.

[30] Foreign Application Priority Data

Jul. 6, 1982 [DE] Fed. Rep. of Germany ..... 3225258

[51] Int. Cl.[4] ..... A47L 9/00

[52] U.S. Cl. ..... 15/326; 15/413; 55/276; 181/231; 181/252; 181/256; 181/272; 417/312

[58] Field of Search ..... 15/326, 413; 55/276; 181/231, 249, 252, 256, 264, 272; 417/312

[56] References Cited

U.S. PATENT DOCUMENTS

| | | | |
|---|---|---|---|
| 1,565,932 | 12/1925 | Hanson | 15/326 X |
| 2,884,185 | 4/1959 | Dolan | 15/326 X |
| 4,185,354 | 1/1980 | Brazier | 15/353 X |
| 4,195,969 | 4/1980 | Whitney | 15/412 X |
| 4,330,899 | 5/1982 | Miller et al. | 15/413 X |
| 4,435,877 | 3/1984 | Berfield | 15/326 |

*Primary Examiner*—Chris K. Moore

*Attorney, Agent, or Firm*—Boniard I. Brown

[57] ABSTRACT

A vacuum cleaner apparatus having separate passages for outgoing air from the blower and for cooling air for the blower motor, and having a number of turns in each of said passages, each of said passages having a plurality of variations in cross-sectional area, the passages being provided with sound-absorbent linings.

22 Claims, 6 Drawing Figures

VACUUM CLEANER APPARATUS

This is a continuation of co-pending application Ser. No. 511,515 filed on July 6, 1983, and now abandoned.

BACKGROUND OF THE INVENTION

The present invention relates to vacuum cleaner apparatus, and more particularly, to vacuum cleaner apparatus substantially reducing the level of sound produced by the apparatus.

Conventional vacuum cleaners which include blowers and blower motors, in operation, produce sound levels of between 70 and 80 dB A. However, such a high sound level is found to be bothersome.

It is, therefore, the aim of the invention to propose a vacuum cleaner with a considerably reduced sound level, for example, approximately 60 dB A.

SUMMARY OF THE INVENTION

To achieve this aim, the invention is characterized in that the blower with its blower motor is mounted in such a manner that vibrations are absorbed, in that the outgoing air of the blower is passed to an outlet through an outlet passage with multiple turns or baffles and the cross-section of which changes a number of times, in that the cooling air for the blower motor flows separately from the outgoing air through a cooling air duct which also has multiple turns or baffles and the cross-section of which also changes several times, and in that the air outlet passage and the cooling air passage are provided in the form of ducts and chambers with a sound-absorbent lining.

Due to the fact that the blower and blower motor are mounted in such a manner that vibrations are absorbed, a transmitting of the vibrations produced there by way of structure-borne noise to the housing of the vacuum cleaner is effectively reduced. The above-mentioned passing of the outgoing air of the blower and of the cooling air of the motor through long ducts and chambers provided with baffles ensures a good damping in the long blow-off passages, which in addition are damped by the sound-absorption linings or mats provided therein. The cross-sections change several times resulting in an absorption of airborne sound over a wide band. It is not absolutely essential to provide the aforementioned sound-absorbing measures on the suction side of the blower. The filter mat which is provided there to a certain degree also serves for the sound absorption and as a sound-absorption filter. It is also important that the cooling air system for the motor is separate from the system for the suction air and outgoing air of the blower. This reliably excludes a contamination of the motor or also a short-circuit which may be produced by possible moisture (dirty water) sucked up together with the suction air, and it is ensured that, independent of the degree of dirt on the filter mat and in the suction passages, the motor always receives sufficient cooling air.

These measures can even be used for cooling by means of the motor cooling air, the sensitive heat-producing electrical components of the vacuum cleaner, in which case these are arranged in the air flow of the motor cooling air.

To obtain as long as possible outlet passages, it is preferred that the housing of the vacuum cleaner should have a rectangular cross-section at least in the region of the outlet passage and of the cooling air passage. Compared to the usual round cross-section of the housing, which is also possible with this invention, the rectangular cross-section provides a larger volume and larger area available for the aforementioned sound-absorbing measures.

In front of the suction opening of the blower it is preferred to provide a grating which evens out the air flow, which also contributes to lowering the sound level.

A sound damper provided in the suction region of the blower serves the same purpose.

It is furthermore preferred that a contact spring be installed in a form-locking manner in the part which carries the blower, in which case the static charge of the metal dirt collecting tank, the antistatic suction hose as well as possibly of the accessories, is grounded by a protective conductor connected with the contact spring.

To prevent the sound absorption being adversely affected by wetting of the sound-absorption mats with which the air outlet passages are lined, it is furthermore preferred that a filter support basket and a one-way check valve with captive float ball be connected in an undetachable manner to the housing portion carrying the blower, thus to prevent any liquid or moist matter that is sucked up from getting into the repeated turns of the air outlet and cooling passages that are lined with sound-absorption mats.

Furthermore, in order to achieve the aim according to the invention, it is necessary that a large outlet opening is provided. To achieve this it is preferred that the rectangular housing be mounted on the round dirt collecting tank.

The materials and the passages of the flow media have been selected in such a manner that the housing portion carrying the blower and the portion bracing the blower are designed in such a way that dirt up to a temperature of 80° C. can be sucked up.

DESCRIPTION OF THE PREFERRED EMBODIMENT

Figure 1:
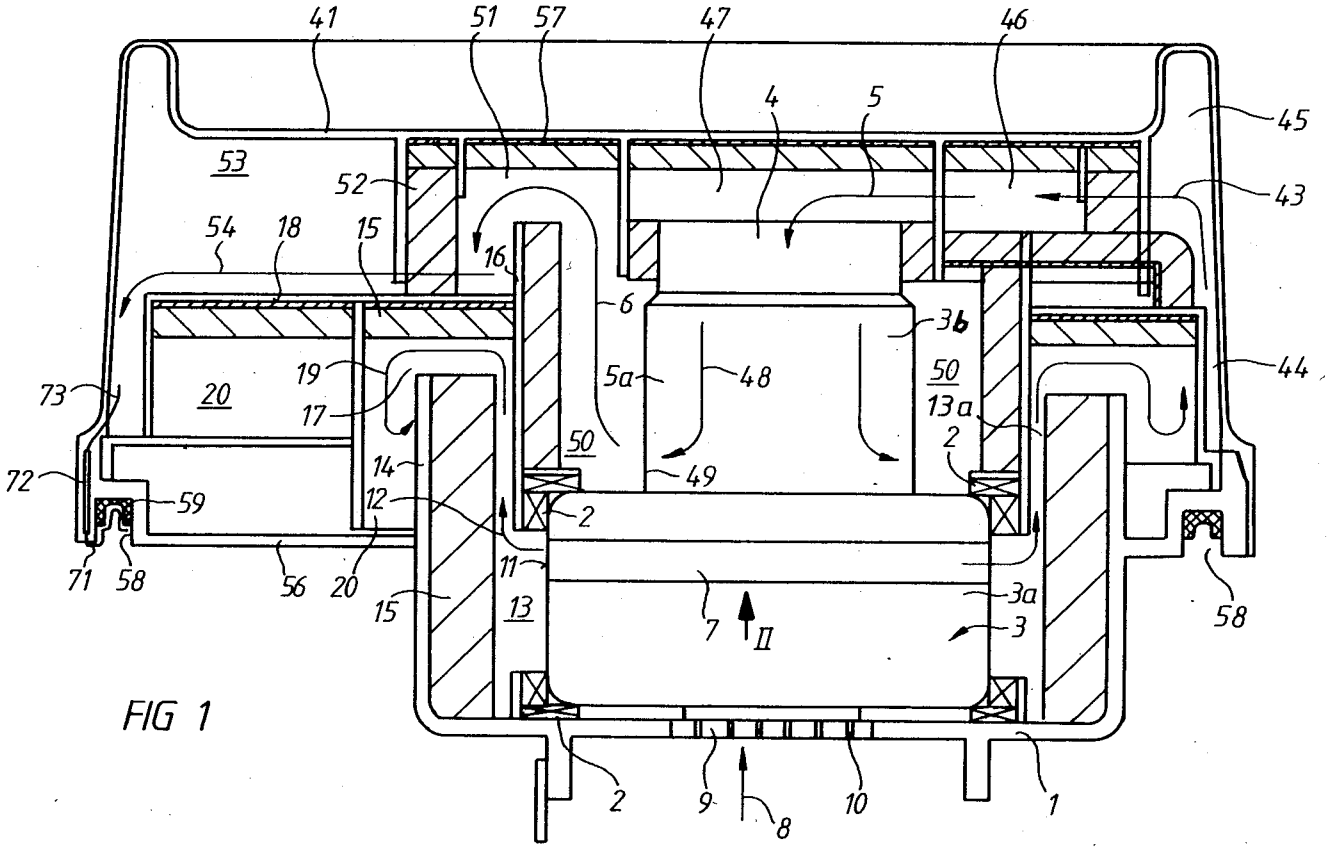
FIG. 1 is a longitudinal sectional view of the upper portion of a vacuum cleaner according to the invention.

Referring to the drawings, a carrier plate 1 has mounted thereon a motor housing 3, rubber sealing elements or strips 2, typically fabricated of foam rubber being disposed between the motor housing and the carrier plate. The motor housing 3 consists of a broad turbine part 3*a* and a narrower motor part 3*b*, at the top of which a radial fan 4 is arranged. This radial fan sucks up the cooling air in the direction of arrow 5, which cooling air is blown off through a blow-off opening 5*a* and rises up in the direction of arrow 6 along the wall of an intermediate plate which will be described further on.

The fan 4 furthermore comprises a multipressure stage turbine wheel 7, with which the suction air is sucked up by way of the suction connection of a suction housing of which no further details are shown, via a suction hose and a filter, the suction air entering in the direction of arrow 8 by way of a suction opening 9 at the underside of the fan 4. According to the invention this suction air undergoes a substantial sound-damping.

In the suction opening 9 an air grating 10 is provided which has a mesh size of 3–8 mm and consists of square plastic rods, this grating having the important advantage that it evens out the flow air sucked up in the direction of arrow 8. It prevents above all a detrimental turbulence at the edges of suction opening 9, which causes whistling noises. The square ribs of this plastic grating are suitably rounded at the suction side.

The turbine wheel 7 has radial outlet or blow-off openings 11, through which the outgoing air flows in the direction of arrow 12 through a duct 13. The duct 13 is formed by an upwardly projecting flange 14 of the carrier plate 1, the wall of this duct being lined with a sound-absorption mat 15. It is important that the cross-section 13*a* of the duct becomes narrower, so that the air flowing through same is speeded up substantially. The other side of the duct is formed by the wall 16 of a clamping plate 18, the air being deflected at position 17 on the fact clamping plate 18 which is lined with damping strips 15. The flow of air is guided in the direction of arrow 19 into an annular duct 20 (see FIG. 2).

The annular duct 20 extends arcuately half-way about the housing. It is formed by two partial annular ducts which are approximately symmetrical to one another, as indicated on the right hand side in FIG. 1.

The annular ducts 20 are not exactly symmetrical to one another; they differ with regard to their radii. The annular duct on the left in FIG. 1 is hereafter described with reference to FIG. 2. It is seen that the air flows in the direction of arrow 21 into a housing opening 22, which can also be seen in FIG. 1. This housing opening 22 is partitioned off by a web 24 of the clamping plate 18, so that the air flows in the direction of arrows 25 and 28 through a duct 26, 27 shaped like a baffle, is then deflected again in the direction of arrow 29 on a web 30 of the clamping plate, and flows in the direction of arrow 31 through an outlet opening in the carrier plate, and at that point flows out of the housing.

However, in place of flowing into the opening 23 in the direction of arrow 21, the air may also continue to flow through the annular duct 20 in the direction of arrow 32, and may, in the direction of arrow 36, enter a chamber 37 by way of an inflow opening 33. The inflow opening 33 is formed by a rib or member 34 of the clamping plate and an adjacent rib 35. The chamber 37 leads into a further sound-damped duct 38, all surfaces which lie in the drawing plane of FIG. 2 being lined with foam mats. The air then flows on in direction of arrow 39 and then passes via a very long route in the region of duct 38 to an outlet opening 40 which is arranged in a hood 41.

Figure 2:
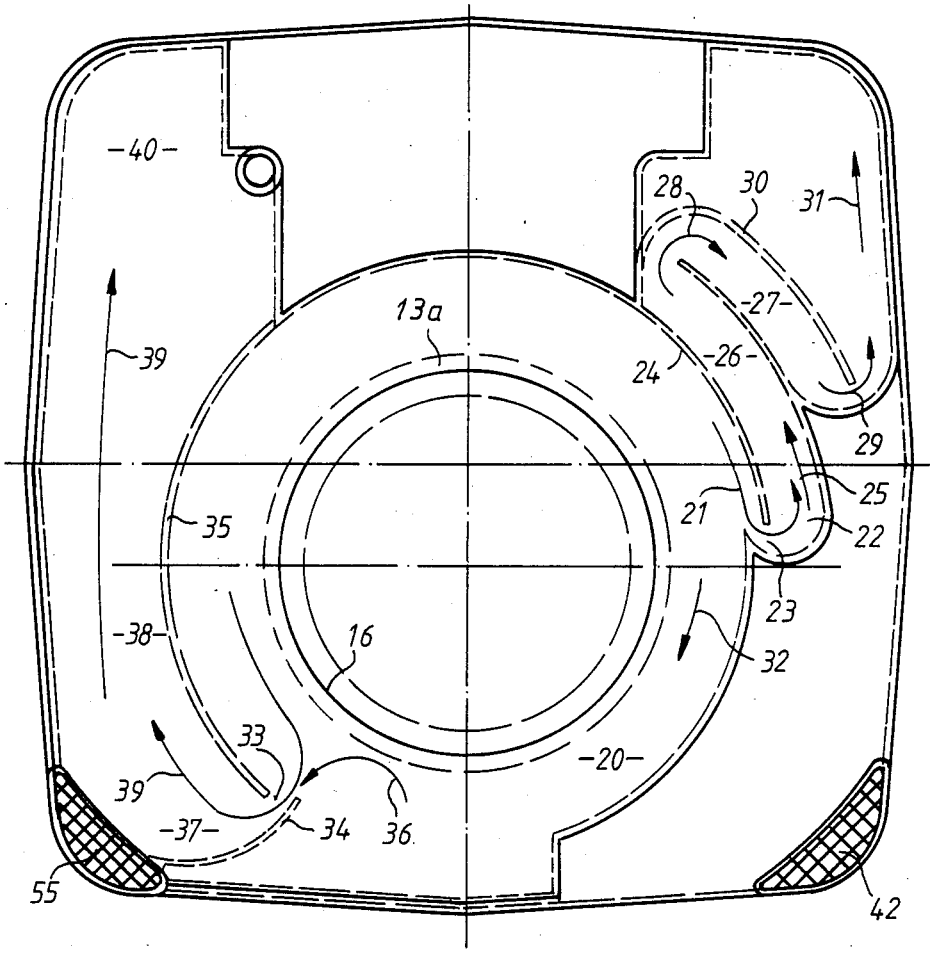
FIG. 2 is a sectional view taken at arrow II in FIG. 1.

On the right-hand side of FIG. 2 a baffle was chosen which is deflected three times so as to obtain relatively the same sound-damped path as that on the left-hand side with chamber 38 which has a baffle with only one deflection, but on the other hand a long, straight, sound-damped path.

An essential feature of the present invention is not, therefore, the splitting up into two sound-damped paths, since this could also be achieved in another manner, but generally the fact that long sound-damped paths are obtained in a clamping plate and an associated sound-proofing hood.

It is also important for the success of the soundabsorption measures that the air which enters the annular duct 20 with a large volume, is first of all speeded up very substantially on the deflection baffles, to subsequently be slowed down again in connected expansion chambers. This makes it possible to achieve a wide band sound-damping because all the surfaces which lie in the drawing plane of FIG. 2 are lined with sound-absorption mats.

The sound-damping of the motor cooling air is hereinafter explained with reference to FIG. 1.

In FIG. 1 the air is sucked up by way of the suction opening 42 of FIG. 2, which in FIG. 1 lies approximately in the region underneath this plate. The air flows by way of a relatively broad duct 44 lined with suitable sound-absorption mats into a chamber 45, where it is deflected in direction of arrow 43, and is fed by way of a radially extending duct 46 to the radial fan 4 of the drive motor. Important in this connection is that also the chamber 47 is damped very strongly with sound-absorption mats, so that all surfaces in contact with the cooling air are lined with suitable sound-absorption mats. The fan 4 now sucks up the cooling air, feeds this cooling air by way of the motor windings in the direction of arrow 48, and then this cooling air flows by way of a not further illustrated outlet opening 49 on the motor housing into a chamber 50 and from there in the direction of arrow 6 through an annular duct 51, to then be deflected on wall 52 which is provided with an opening which cannot be noted from FIG. 1. From there the air flows into an annular chamber 53 (direction of arrow 54) which extends practically over 270 degrees of the housing, in which connection it is advantageous when further electronic components of the apparatus are arranged in this annular chamber 53, so that they can be acted upon and cooled by this cooling air. The electronic components consist, for example, of a triac for an automatic switching on and off with an associated suppressor choke and similar parts which produce a considerable amount of waste heat, and which in this manner can be cooled. The air then flows by way of a housing operation 55 shown in FIG. 2 out of the clamping plate. This housing opening 55 lies underneath the horizontal part 56 of the carrier plate 1 and cannot be seen in FIG. 1.

Also here it is important that all the surfaces in contact with the motor cooling air are sound-damped, and the air is deflected a number of times by way of baffles, so that also here there occurs a considerable sound-damping of the motor cooling air.

The sound-absorption mats consist preferably of a foam material or of a closed-pore sponge rubber, a layer of bitumen mats 57 preferably being placed underneath same so as to ensure a wide-band sound-damping.

The housing hood 41 and the clamping plate 18, as well as the bearing plate 56 consist of injection-moulded plastic parts. Also important with the present invention is that on the horizontal part 56 of the carrier plate 1 a channel, open towards the bottom, is arranged extending circumferentially around same, in which duct 58 a U-shaped packing 59 is provided, the edge portion of the vacuum cleaner tank which is open to the top being inserted into and interfitting with the bottom of the U-profile. This ensures a further sound-damping and at the same time a sealing-off and, accordingly, a simultaneous centering of the carrier plate 1 in respect of the vacuum cleaner tank, i.e. there is no contact between solid parts, so that a transmitting of vibrations is avoided.

The sound-absorption measures according to the invention can be produced in an extremely economical manner seeing that all the parts consist of injection-molded parts, which only on the inside have to be provided with suitable sound-absorption measures, i.e. lined with sound-absorption mats and bitumen mats.

Figure 4:
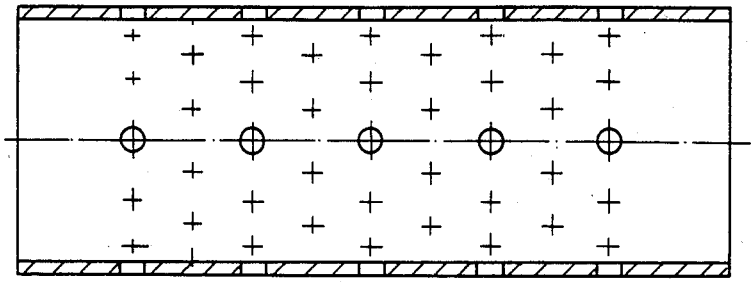
FIG. 4 is a longitudinal sectional view of an absorption damper utilized with the invention.
Figure 3:
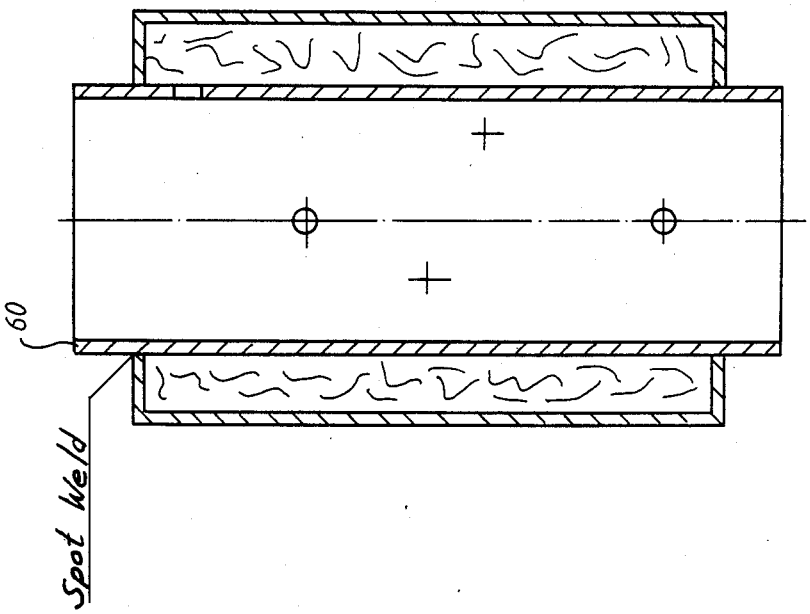
FIG. 3 is a longitudinal sectional view of a sound damper utilized with the invention.

It is possible to use additional Helmholtz resonators. Likewise it is possible, as shown in FIG. 3 and FIG. 4, as well as in FIG. 5 and FIG. 6, to arrange either a sound-damper lined with mineral wool, or an absorption or reflection damper (as per FIGS. 5 and 6), in the suction region of the motor, i.e. in the region of the air grating 10 and the suction opening 9. In this case a plug-in collar is arranged flush with the outer edge of the suction opening 9, into which collar the sound-dampers shown in FIGS. 3–6 are plugged-in with their associated collars 60, 61.

Figure 6:
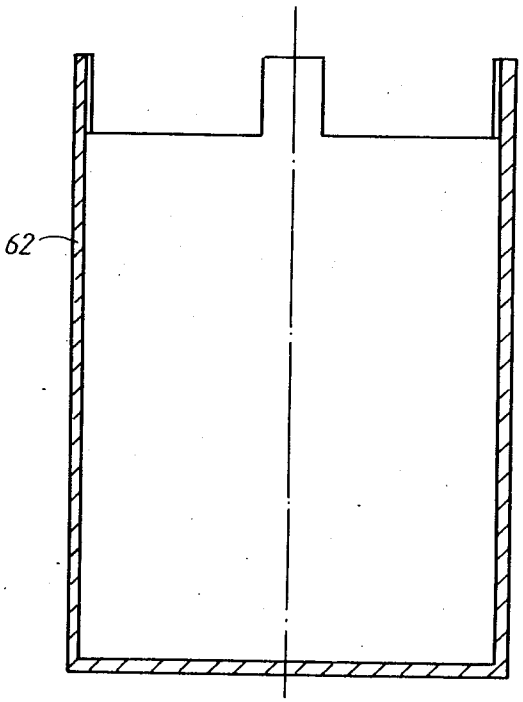
FIG. 6 is a longitudinal sectional view of an interior member of the reflection damper of FIG. 5.
Figure 5:
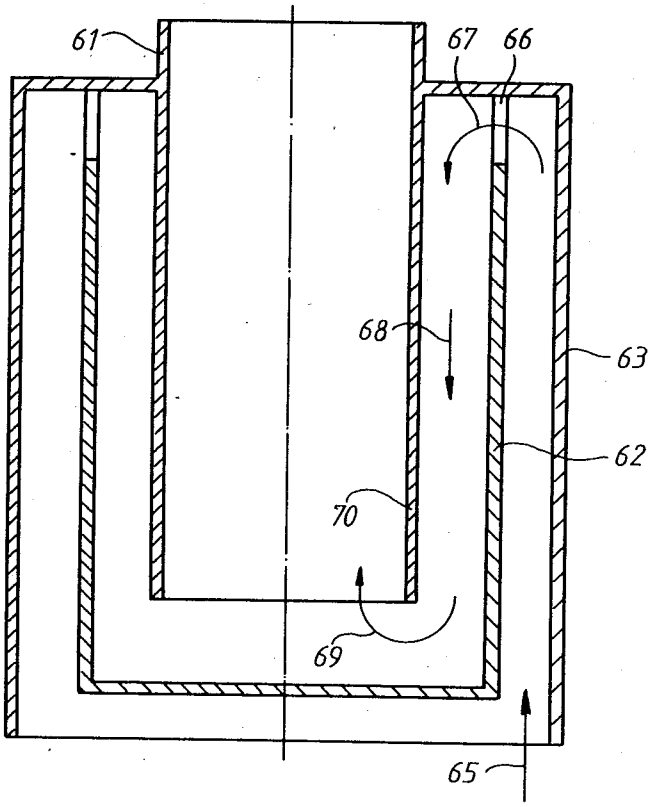
FIG. 5 is a longitudinal sectional view of a reflection damper utilized with the invention.

FIG. 6 shows the inside member of the sounddamper of FIG. 5. The inside member 62 is inserted axially into the part 63 shown in FIG. 5. The air is sucked up in the direction of arrow 65, deflected through the shackles 66 in the direction of arrow 67, moved downwards in the direction of arrow 68, and is led in the direction of arrow 69 through the inside member 70 of the sound-damper to the suction opening 9 of the carrier plate.

Similar conditions also exist in the case of FIG. 3 where a dampened silencer is used. It is also possible to provide a dampened Helmholtz resonator on the side of the motor cooling air, which preferably is arranged in the region of the annular duct 45. The air does not flow through this duct 45 itself, but as a hollow element the duct is provided in its outer walls with bores of an accurately defined diameter and spacing, leading into the inside, so that the inflowing cooling air is moved along the surface and flows over the edges of these bores, as a result of which a damping effect is obtained.

In the region of the U-shaped sealing lip 59 a narrow strip of copper 71 is arranged, the shape of which is adapted to that of the U-profile and which rests electrically conductive on the metal edge of the vacuum cleaner tank. As shown in FIG. 1, this strip of copper is connected by way of a conductor lug 72 and a connection 73 to the grounded conductor of the mains voltage, so that the electrostatic charges occurring on the vacuum cleaner tank can be led off to the supply main by way of this copper conductor 71.

The soft rubber rings which ensure the low-vibration mounting of the blower and the blower motor, must have a suitable Shore hardness and size and must at the same time be constructed in such a manner that the turbine is prevented from turning round. The dimensions of the air passages and air chambers must also be correctly chosen, essentially as shown in the drawings. Important are the parameters of duct width, duct height and duct length. Also the correct choice of sound-absorption mats and the installation of the mats at the correct places are important. The inlet and outlet cooling air must also be guided, as explained in the foregoing, so that also here the sound level is kept as low as possible.

The invention has been described with reference to its illustrated preferred embodiment. Persons skilled in the art may, upon exposure to the teachings herein, conceive variations in the mechanical development of the components therein. Such variations are deemed to be encompassed by the disclosure, the invention being delimited only by the appended claims.

The inventor claims:

1. Vacuum cleaner apparatus comprising:

a housing, blower means including a blower motor mounted on the housing by mounting means adapted to reduce vibration transmission between the blower means and said housing, means including ducts and a chamber defining a suction air outlet passage, said outlet passage varying in cross-sectional area and having a plurality of turns, said suction air outlet passage includes a duct and diverts a first portion of the suction air outlet flow via a baffle to a first outlet, said duct conducting a second portion of the outlet suction air flow to be directed by a deflecting member through an elongated route to another outlet, and means including ducts and chambers defining a cooling air passage separate throughout its length from said suction air outlet passage and having an inlet section and an outlet section, both the inlet section and the outlet section communicating with the blower motor and with the exterior ambience, said cooling air passage having a plurality of turns.

2. A vacuum cleaner apparatus according to claim 1, wherein:

said cooling air passage includes a chamber of relatively large cross-sectional area wherein cooling air velocity is slowed, followed by a duct of reduced cross-sectional area wherein cooling air velocity is increased, and a passage duct of enlarged cross-sectional area wherein air flow velocity is decreased.

3. Vacuum cleaner apparatus comprising:

a housing, blower means including a blower motor mounted on the housing by mounting means adapted to reduce vibration transmission between the blower means and said housing, means including ducts and a chamber defining a suction air outlet passage, said outlet passage varying in cross-sectional area and having a plurality of turns, said suction air outlet passage including a chamber of relatively large cross-sectional area wherein air flow velocity is slowed, followed by a reduced cross-sectional area wherein air flow velocity is increased, and an enlarged cross-sectional area wherein air flow velocity is decreased, said suction air outlet passage including a duct and divierting a first portion of the suction air outlet flow via a baffle to a first outlet, said duct conducting a second portion of the outlet section air flow to be directed by a deflecting member through an elongated route to another route, and means including ducts and chamber defining a cooling air passage separate throughout its length from said suction air outlet passage and having an inlet section and an outlet section, both the inlet section and the outlet section communicating with the blower motor and with the exterior ambience, said cooling air passage having a plurality of turns.

4. Vacuum cleaner apparatus according to claim 1, and further including:

sound-absorbent lining mounted on at least some of said ducts and chambers of the outlet passage and the cooling air passage.

5. Vacuum cleaner apparatus according to claim 4, wherein:

said housing is of generally rectangular cross-section at least in the region of said air outlet passage and said cooling air passage to provide substantial area for mounting sound-absorbent linings.

6. Vacuum cleaner apparatus according to claim 3, and further including:

sound-absorbent lining mounted on at least some of said ducts and chambers of the outlet passage and the cooling air passage.

7. Vacuum cleaner apparatus according to claim 6, wherein:

said housing is of generally rectangular cross-section at least in the region of said air outlet passage and said cooling air passage to provide substantial area for mounting sound-absorbent linings.

8. Vacuum cleaner apparatus according to claim 3, wherein:

said housing is of generally rectangular cross-section at least in the region of said air outlet passage and said cooling air passage to provide substantial area for mounting sound-absorbent linings.

9. Vacuum cleaner apparatus according to claim 1, and further including:

a grating disposed upstream of an intake opening for the blower motor to reduce sound level and to equalize air intake flow over the area of the opening.

10. Vacuum cleaner apparatus according to claim 3, and further including:

a grating disposed upstream of an intake opening for the blower motor to reduce sound level and to equalize air intake flow over the area of the opening.

11. Vacuum cleaner apparatus comprising:

a housing, blower means including a blower motor mounted on the housing by mounting means adapted to reduce vibration transmission between the blower means and said housing, means including ducts and a chamber defining a suction air outlet passage, said outlet passage varying in cross-sectional area and having a plurality of turns, means including ducts and chambers defining a cooling air passage separate throughout its length from said suction air outlet passage and having an inlet section and an outlet section, both the inlet section and the outlet section communicating with the blower motor and with the exterior ambience, said cooling air pssage having a plurality of turns, and heat-discharging electrical elements disposed on at least one wall of the cooling passage for cooling of the elements.

12. Vacuum cleaner apparatus comprising:

a housing, blower means including a blower motor mounted on the housing by mounting means adapted to reduce vibration transmission between the blower means and said housing, means including ducts and a chamber defining a suction air outlet passage, said outlet passage varying in cross-sectional area and having a plurality of turns, means including ducts and chambers defining a cooling air passage separate throughout its length from said suction air outlet passage and having an inlet section and an outlet section, both the inlet section and the outlet section communicating with the blower motor and with the exterior ambience, said cooling air passage having a plurality of turns, said cooling air passage including a chamber of relatively large cross-sectional area wherein cooling air velocity is slowed, followed by a duct of reduced cross-sectional area wherein cooling air velocity is increased, and a passage duct of enlarged cross-sectional area wherein air flow velocity is decreased, and heat-discharging electrical elements disposed on at least one wall of the cooling passage for cooling of the elements.

13. Vacuum cleaner apparatus according to claim 1, wherein:

said suction air outlet passage comprises ductwork of varying cross-sectional area.

14. Vacuum cleaner apparatus according to claim 3, wherein:

said suction air outlet passage comprises ductwork of varying cross-sectional area.

15. Vacuum cleaner apparatus according to claim 1, and further including:

sound-damping means disposed in the suction region of the blower motor.

16. Vacuum cleaner apparatus according to claim 3, and further including:

sound-damping means disposed in the suction region of the blower motor.

17. Vacuum cleaner apparatus comprising:

a housing, blower means including a blower motor mounted on the housing by mounting means adapted to reduce vibration transmission between the blower means and said housing, means including ducts and a chamber define a suction air outlet passage, said outlet passage varying in cross-sectional area and having a plurality of turns, means including ducts and chambers defining a cooling air passage separate throughout its length from said suction air outlet passage and having an inlet section and an outlet section, both the inlet section and the outlet section communicating with the blower motor and with the exterior ambience, said cooling air passage having a plurality of turns, and electrical contact means disposed between a metal vacuum cleaner tank and a portion of the housing adapted to engage the vacuum cleaner tank to ground electrostatic charges from the vacuum cleaner tank via a conductor connected with the contact means.

18. Vacuum cleaner apparatus comprising:

a housing, blower means including a blower motor mounted on the housing by mounting means adapted to reduce vibration transmission between the blower means and said housing, means including ducts and a chamber defining a suction air outlet passage, said outlet passage varying in cross-sectional area and having a plurality of turns, said suction air outlet passage including a chamber of relatively large cross-sectional area wherein air flow velocity is slowed, followed by a reduced cross-sectional area wherein air flow velocity is increased, and an enlarged cross-sectional area wherein air flow velocity is decreased, means including ducts and and chambers defining a cooling air passage separate throughout its length from said suction air outlet passage and having an inlet section and an outlet section, both the inlet section and the outlet section communicating with the blower motor and with the exterior ambience, said cooling air passage having a plurality of turns, and electrical contact means disposed between a metal vacuum cleaner tank and a portion of the housing adapted to engage the vacuum cleaner tank to ground electrostatic charges from the vacuum cleaner tank via a conductor connected with the contact means.

19. Vacuum cleaner apparatus according to claim 1, and further including:

filter means including a one-way check valve mounted on the housing to prevent introduction into said outlet passage or said cooling air passage of liquid drawn in by the blower means.

20. Vacuum cleaner apparatus according to claim 1, wherein:

said blower means and the housing are secured together by interfitting portions between which vibration-absorbing material is disposed to reduce vibration transmission.

21. Vacuum cleaner apparatus according to claim 3, wherein:

said blower means and the housing are secured together by interfitting portions between which vibration-absorbing material is disposed to reduce vibration transmission.

22. A vacuum cleaner apparatus according to claim 3, wherein:

said cooling air passage includes a chamber of relatively large cross-sectional area wherein cooling air velocity is slowed, followed by a duct of reduced cross-sectional area wherein cooling air velocity is increased, and a passage duct of enlarged cross-sectional area wherein air flow velocity is decreased.

* * * * *